United States Patent [19]

Irons

[11] 4,376,700

[45] Mar. 15, 1983

[54] METHOD FOR BENEFICIATING COAL ORE

[75] Inventor: Stanton D. Irons, Northampton, Pa.

[73] Assignee: Bethlehem Steel Corporation, Bethlehem, Pa.

[21] Appl. No.: 194,742

[22] Filed: Oct. 7, 1980

Related U.S. Application Data

[63] Continuation of Ser. No. 52,152, Jun. 26, 1979, abandoned.

[51] Int. Cl.[3] ..... B03B 5/44

[52] U.S. Cl. ..... 209/17; 209/172; 252/60; 252/311

[58] Field of Search ..... 252/60, 309, 311, 312; 209/172, 173, 172.5, 17, 209; 406/47

[56] References Cited

U.S. PATENT DOCUMENTS

| | | | |
|---|---|---|---|
| 1,839,117 | 12/1931 | Nagelvoort | 209/172 |
| 2,150,917 | 3/1939 | Foulke et al. | 209/172 |
| 2,151,578 | 3/1939 | Alexander et al. | 209/172 |
| 2,380,166 | 7/1945 | Griffin | 252/311.5 |
| 2,693,878 | 11/1954 | Driessen et al. | 209/172.5 |
| 2,833,618 | 5/1958 | Creutz et al. | 23/14.5 |
| 2,903,423 | 9/1959 | Mondria et al. | 210/21 |
| 2,932,395 | 4/1960 | Marot | 209/172.5 |
| 3,148,140 | 9/1964 | Kaiser | 210/21 |
| 3,261,559 | 7/1966 | Yavorsky et al. | 209/17 X |
| 3,347,370 | 10/1967 | Rampacek et al. | 209/172 |
| 3,348,675 | 10/1967 | Tveter | 209/5 |
| 3,364,035 | 1/1968 | Belk | 209/123 X |
| 3,502,586 | 3/1970 | Bauer et al. | 252/309 X |
| 3,764,545 | 10/1973 | Aguadisch et al. | 252/311 X |
| 3,822,015 | 7/1974 | Hsieh et al. | 209/173 |
| 3,903,012 | 9/1975 | Brandreth | 252/194 |
| 4,055,480 | 10/1977 | Smith et al. | 208/11 |
| 4,148,736 | 4/1979 | Meister | 252/8.55 |
| 4,173,530 | 11/1979 | Smith et al. | 209/172 X |

OTHER PUBLICATIONS

"Sink-and-Float Separation Commends New Attention", W. B. Foulke, *Engineering and Mining Journal,* May, 1938.

*Primary Examiner*—Ralph J. Hill

*Attorney, Agent, or Firm*—Joseph J. O'Keefe; Charles A. Wilkinson; Michael Leach

[57] ABSTRACT

A new heavy liquid parting medium comprising an emulsion of water and a substantially water immiscible heavy parting liquid for use in beneficiating ores by gravity separations such as sink-float processes. The specific gravity of the emulsion parting medium can be adjusted by proportioning the relative amounts of water and the substantially water immiscible heavy liquid. As-mined coal is beneficiated using a water-trichlorofluoromethane emulsion as the parting medium in a sink-float separation process.

6 Claims, 1 Drawing Figure

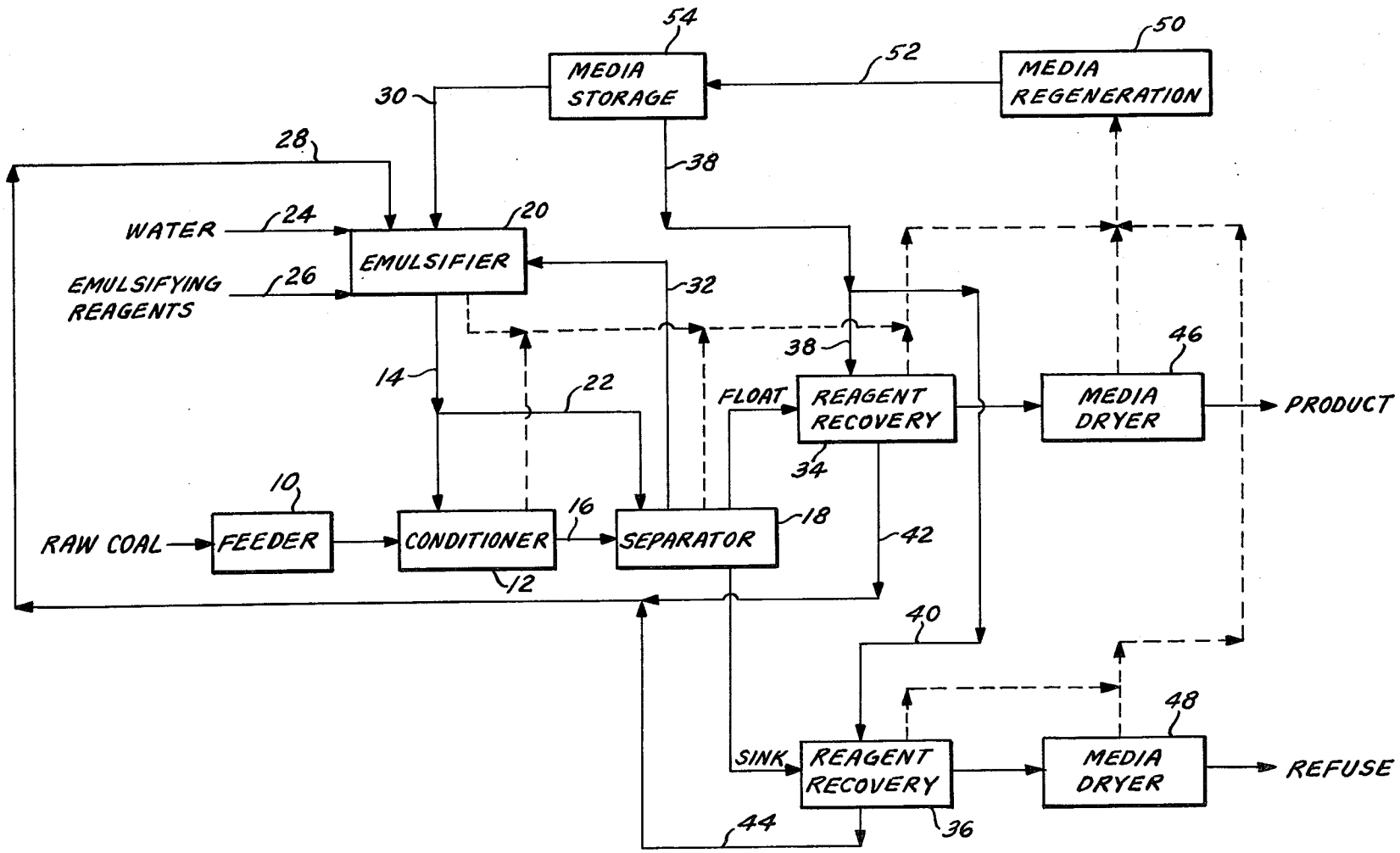
PRODUCT
REFUSE
MEDIA REGENERATION
MEDIA DRYER
MEDIA DRYER
REAGENT RECOVERY
REAGENT RECOVERY
MEDIA STORAGE
SEPARATOR
EMULSIFIER
CONDITIONER
FEEDER
FLOAT
SINK
WATER
EMULSIFYING REAGENTS
RAW COAL
50
46
48
52
38
42
40
36
34
18
54
38
32
44
22
16
20
12
30
14
28
24
26
10

METHOD FOR BENEFICIATING COAL ORE

This is a continuation, of application Ser. No. 052,152, filed June 26, 1979, now abandoned.

FIELD OF THE INVENTION

This invention relates to a process for separating mixtures of solid materials having different specific gravities, and more particularly to a process for separating materials utilizing a parting liquid having a specific gravity intermediate the specific gravities of the materials to be separated.

BACKGROUND OF THE INVENTION

All ores, whether metallic or non-metallic, are aggregates of minerals in which the valuable portion to be recovered is generally mixed with foreign material called gangue. The separation of the valuable from the worthless portion is the art of ore dressing and employs such processes as, for example, jigging, tabling, cyanidation and flotation. A preliminary step to all the methods of ore dressing is the crushing and grinding of the ore to liberate the valuable material from the waste. The ore is ground, or comminuted, until the valuable material is broken free from any attached or enclosing gangue. The class of the ore to be treated determines the subsequent ore dressing treatment after comminution.

In the gravitational separation of values from ores, the difference in specific gravity between the various materials composing the ores is utilized. Gravitational separation of materials of different densities by procedures such as sink-float processes is well known and is based on the law of physics that the loss of weight of a body immersed in any liquid equals the weight of the liquid displaced. Accordingly, bodies lighter than the weight of the volume of a liquid they displace will float on it, while those heavier than the weight of the volume of a liquid they displace will sink in it. Therefore, if an ore is sufficiently ground to free the valuable material and is immersed in a parting liquid having a specific gravity intermediate the specific gravities of the valuable and worthless portions, a positive separation can be achieved and either the "sinks" or the "floats", or both, may be recovered for its values.

As-mined coal comprises pure coal having a specific gravity of about 1.3 and solid foreign matter, such as rock, slate and pyrite, having a specific gravity typically from 1.7 to 4.9. These components occur in all combinations, so that the as-mined coal is a very heterogeneous material. By introducing the crushed as-mined coal into a parting liquid having a specific gravity intermediate that of the coal and foreign material, the coal can be recovered as "floats" apart from the gangue.

The parting medium employed may be a mixture of some finely divided solid matter suspended in water in which case there must be a constant agitation of the liquid in order to maintain a suspension. This suspension of particulates such as sand, magnetite or barite provides a parting medium that is heavier than water. The specific gravity of this type of parting medium can be controlled by varying the proportions of the solid matter and water to suit optimum conditions in the coal cleaning.

The use of non-aqueous heavy-gravity liquids is also well known in the art of beneficiating coal by the sink-float process. In most part, these non-aqueous heavy liquids are halogenated hydrocarbons, particularly those containing from 1 to 2 carbon atoms and from 2 to 6 halogen atoms. Reference may be made to U.S. Pat. Nos. 2,150,917 and 3,348,675 for listings of some of the halogenated hydrocarbons that can be used as heavy parting liquids which are hereby incorporated by reference.

In "Sink-and-Float Separation Commands New Attention," *Engineering and Mining Journal,* May 1938, Vol. 139, No. 5, W. B. Foulke discusses the general properties that a heavy liquid should possess. Minimum miscibility with water is most important in that any heavy liquid in which water is soluble would decrease in specific gravity during use because water, which is generally associated with the mined and the ground ores, would be continually extracted by the heavy liquid. Accordingly, some means would have to be provided to return the heavy liquid to its proper specific gravity. Substantial immiscibility with water is a property common to the halogenated hydrocarbons, thus making them attractive parting liquids.

Because the desired specific gravity for the heavy parting medium necessary for a particular gravity separation may not be possessed by any single halogenated hydrocarbon, the practice is to mix two or more such heavy liquids in proportions that afford a parting medium of the chosen specific gravity. Alternatively, hydrocarbons, either aliphatic or carbocyclic, of low specific gravity can be added to a halogenated hydrocarbon to lessen the specific gravity of the parting medium.

There are problems with this method of adjusting the specific gravity of a halogenated hydrocarbon heavy liquid by adding an amount of another halogenated hydrocarbon or unsubstituted hydrocarbon. Since halogenated hydrocarbons are expensive relative to unsubstituted hydrocarbons, a second halogenated hydrocarbon for diluting purposes is undesirable. On the other hand, while halogenated hydrocarbons are generally non-flammable, dilution with highly flammable hydrocarbons creates a serious safety question in the construction of material handling and electrical equipment. Suitable liquids for adjusting the specific gravity of a heavy parting liquid while avoiding these problems are not known.

Thus, there is a need for a new heavy parting medium whose specific gravity can be easily adjusted without the need for addition of halogenated or unsubstituted hydrocarbons.

There is also a need for a new heavy liquid that does not present flammability safety problems.

There is yet a need for a new heavy liquid whose specific gravity can be readily adjusted over a range of about 1.30 to 1.50 to beneficiate various metallurgical coals at a specific gravity less than 1.50.

There is a further need for a heavy liquid for use in making coal separations which possesses low viscosity and surface tension, ease of density adjustment, ease of regeneration for re-use and is non-destructive to the coal, non-flammable, non-toxic and non-contaminating.

There is a still further need for a method of adjusting the specific gravity of a substantially water-immiscible parting liquid by the addition of water.

There is yet a further need for a new parting medium comprising a water-immiscible liquid and water the specific gravity of which can be readily varied to desired values.

SUMMARY OF THE INVENTION

I have discovered a new liquid for use as the parting medium in gravity separations such as the sink-float process comprising an emulsion of a substantially water immiscible parting liquid and water. By parting liquid I mean any liquid which can be used to effect a separation of a mixture of solids according to their densities or, equivalently, their specific gravities. In most gravity separation processes, the specific gravities of the solids to be separated are greater than the specific gravity of water and, necessarily, the parting liquid must also have a specific gravity greater than water. Accordingly, these parting liquids are commonly referred to as heavy liquids. While the remainder of this specification will be written primarily in terms of heavy liquids and emulsions comprising water and a substantially water immiscible heavy liquid, it is to be understood that the invention also encompasses emulsions of water and a substantially water immiscible parting liquid that has a specific gravity less than water.

By adding an appropriate quantity of water to a quantity of heavy liquid and emulsifying, a new heavy liquid parting medium can be obtained having a desired, precalculated specific gravity. Furthermore, in addition to being able to adjust the specific gravity of the water immiscible heavy liquid by forming an emulsion with water, the specific gravity of the emulsion itself can be varied by adding further quantities of either the heavy liquid or water. The specific gravities of these stable emulsion parting media can be adjusted and controlled for the most part between the specific gravities of the heavy liquid and water.

A mixture of solids to be separated by means of their different specific gravities is introduced into a bath of a parting medium which is formed by emulsifying a substantially water immiscible heavy liquid and water. Those solids having a specific gravity less than that of the emulsion parting medium will float in the medium whereas those solids having a specific gravity greater than that of the emulsion will sink to the bottom. These floats and sinks are separately recovered.

An emulsion of water and a substantially water immiscible parting liquid when used as the parting medium in a separating vessel affords a new means for performing gravity separations, including sink-float separations, on mixtures of solids having different densities. Typical separating vessels for containing the emulsion parting medium in gravity separations include cones, classifiers, drum-type vessels or vortex separating vessels such as hydrocyclones all of which are well-known in the art.

BRIEF DESCRIPTION OF THE FIGURE

The sole FIGURE is a block diagram depicting a preferred embodiment for practicing the invention to beneficiate coal.

DETAILED DESCRIPTION OF THE INVENTION

New heavy liquids for use as the parting medium in sink-float separation processes can be prepared by emulsifying water and a substantially water immiscible heavy liquid. Emulsions can be prepared in numerous ways such as hand stirring, mechanical stirring, aeration, propeller agitation, turbine agitation, homogenization and ultrasonics. The object is to dispense the internal phase in the external phase in such a manner as to produce sufficiently small particle sizes so that coalescence and breakdown of the emulsion is retarded. The worker is directed to "Encyclopedia of Chemical Technology, Kirk-Othmer," 2nd Ed. (John Wiley & Sons, Inc. 1965) Vol. 8 pp. 117–152 for a practical understanding of emulsions and techniques used in the art.

While in some instances a stable water-heavy liquid emulsion can be readily prepared merely by physical means, the addition of emulsifying agents, or emulsifiers, is, in most instances, necessary to create a stable emulsion. Emulsifiers may be classified according to their properties as either ionic or nonionic. The molecular structures of the ionic emulsifiers characteristically possess an organic lipophilic group and a hydrophilic group which in many cases is ionizable. In contrast, the nonionic emulsifiers have a completely covalent molecular structure.

In general, the hydrophile-lipophile balance (HLB) of an emulsifier is an expression of the relative simultaneous attraction of an emulsifier for water and for oil; in this case the substantially water immiscible heavy liquid would be the oil. The HLB number of an emulsifier depends on its chemical composition and the extent of ionization. A strongly lipophilic emulsifier (propylene glycol monostearate) has a low HLB number (3.4); a hydrophilic emulsifier (polyoxyethylene monostearate) has a high HLB number (11.1); a strongly hydrophilic emulsifier (sodium oleate) has a very high HLB number (18).

Emulsifiers are used to facilitate the formation of the emulsion or to enhance the stability of the emulsion, or both. The HLB number of an emulsifier indicates the type and the behavior characteristics of the emulsion. It may generally be stated that emulsifiers having low HLB numbers will tend to form water in oil emulsions and, conversely, emulsifiers having high HLB values will tend to form oil in water emulsions. The HLB values of many emulsifiers have been published and those of commercially available agents are readily obtainable from the manufacturer. Nevertheless, the best HLB and best chemical class of emulsifiers to be used in forming a particular emulsion must be determined experimentally for each situation.

Although the HLB value of an emulsifying agent is not absolutely indicative of its solubility in water or oils, it is of some guidance in deciding in which phase the emulsifier should be dissolved. It is reasoned that the oil phase of an emulsion possibly contains the oil-soluble (lipophilic) portion of the emulsifier and the aqueous phase the water-soluble (hydrophilic) portion. Thus, emulsifiers of low HLB (2–8) tend to be oil soluble and those of high HLB (14–18) tend to be water soluble. Use of a co-emulsifier often improves the solubility of the other emulsifier.

The dilemma in creating an acceptable emulsion of water and heavy liquid is the choice of the emulsifier or combination of emulsifiers that affords ease of formation and maximum stability of the emulsion in view of the myriad emulsifying agents available. An empirical scheme called the HLB surfactant selection system has been devised that is based upon the recognition that typically oil in water emulsions are best prepared with water-soluble emulsifiers and water in oil emulsions are best prepared with oil-soluble emulsifiers. Although this procedure entails some trial-and-error, the amount of the trial-and-error experimentation is greatly reduced and leads more directly to the desired results.

One commences the selection system by ascertaining the relative amounts of water and water immiscible parting liquid, based on their specific gravities, that are needed to yield an emulsion having a predetermined specific gravity and by having on hand emulsifiers of known HLB values. While a single emulsifying agent is normally sufficient, the practice prefers to blend two or more emulsifiers. The HLB value of a particular blend can be calculated from the expression $xA+(1-x)B$ where x is the proportion in the blend of agent 1 having HLB value A and (1-x) is the proportion of agent 2 having HLB value B.

The selection system consists of three steps: (1) determining a preferred HLB of the emulsifier or blend of emulsifiers for the desired combination of water and heavy liquid that will yield an emulsion having a selected, precalculated specific gravity; (2) trying various emulsifier chemical types at the preferred HLB ascertained in step (1); and (3) determining the optimum HLB value.

In the first step of determining the preferred HLB any matched pair of emulsifiers, one hydrophilic and one lipophilic, are selected. By match pair of emulsifiers is meant two emulsifiers possessing, in part, similar chemical structures; for example, sorbitan monooleate and polyoxyethylene sorbitan monooleate. Test emulsions are prepared using a different relative proportion of each emulsifier in each vessel containing the appropriate quantities of water and heavy liquid. For this initial testing an amount of emulsifier approximately 10–20% by weight of the heavy liquid is used. One or more of the test emulsions will be noticeably superior, although not necessarily very good. If the emulsions appear to be roughly of equal quality, that is to say all fairly good or all fairly bad, then test emulsions should again be prepared using less emulsifier or more emulsifier respectively.

The evaluation of the quantity of an emulsion will usually be based on its stability; that is the inability of the dispersed phase to agglomerate and increase in size. In other words, the degree to which the emulsion separates into its ingredients will be the focus of the evaluation.

With the instant invention stability was determined using tracer particles of coal/refuse (approx. size ¼") which had a specific gravity slightly greater than the emulsion specific gravity, but less than the specific gravity of the heavy liquid. These tracer particles were acquired by performing separations in standard heavy liquids of known or prepared specific gravity. A tracer particle placed into a stable emulsion would sink and remain at the bottom, whereas the tracer solids would begin to float on the heavy liquid phase as an unstable emulsion separated. If the tracer solids did not commence floating after about 1 hour without additional agitation of the emulsion, the emulsion was judged to be stable. Whatever criteria is used in assessing the test emulsions, a preferred HLB value (±2) is obtained for the emulsifier system that will work best regardless of chemical type.

Once the preferred HLB range is ascertained, the second step finds the best chemical type of emulsifier system. While the blend of emulsifiers used in step (1) established a preferred HLB range, there may be blends of other emulsifier chemical types that are better or more efficient. However, any selected chemical type will perform best within the preferred HLB range determined in step (1). In addition to testing emulsifier blends of similar chemical type, various low HLB emulsifiers of different chemical types should be paired with high HLB emulsifiers. Each pair should, however, bear a chemical relationship. Each pair is blended in a weight ratio that yields the preferred HLB. Thus, the best blend of emulsifying agents can be selected for the preferred HLB range.

The final step is to prepare blends of the selected emulsifier system having incremental HLB values on either side of the preferred HLB. The result is the exact blend with the chosen pair for producing the optimum HLB and, concomitantly, the optimum emulsion.

By following the HLB selection system and emulsifying predetermined quantities of water and a substantially water immiscible parting liquid, a new liquid parting medium can be formulated that has a preselected specific gravity for separating a mixture of solids according to their specific gravities. The specific gravity of the emulsion parting medium can be selected within a range from 1.0 (sp. gr. $H_2O$) to the specific gravity of the water immiscible parting liquid. Depending upon the relative quantities of water and parting liquid composing the emulsion, the water may be dispersed in the parting liquid (water in oil) or the parting liquid may be dispersed in the water (oil in water).

Emulsions of water in trichlorofluoromethane were formed using a mixture of the hydrophilic polyoxyethylene-(4)-sorbitan monolaurate and the lipophilic sorbitan monooleate with the ratio of these emulsifiers that yield an HLB value of 8 affording the most stable emulsions. These emulsions could be produced using less than 1% by weight of emulsifier mixture to total weight of emulsion.

The invention will now be described in greater detail employing water and trichlorofluoromethane emulsions as a new heavy liquid for beneficiating coal. Nevertheless it is to be understood that the invention comprises emulsions of water and substantially water immiscible parting liquids and their use as the parting medium in sink-float separation processes and other gravity separations for separating a mixture of solids according to their specific gravities.

It is generally desirable in the beneficiation of metallurgical coals using a sink-float separation process that the parting medium possess a specific gravity between 1.30 and 1.50. However, no heavy liquid is known that has sufficient, acceptable characteristics for making coal separations; namely, low viscosity and surface tension, non-flammability, non-toxicity, ease of density adjustment, case of regeneration for re-use, non-destructiveness to the coal and non-contaminating. While trichlorofluoromethane comes closest to satisfying these requirements (see U.S. Pat. No. 4,055,480 and "Demonstration Plant Test Results of the Otisca Process Heavy Liquid Beneficiation of Coal", a paper presented by D. V. Keller, Jr., C. D. Smith and E. F. Burch on Mar. 7, 1977 at the Annual SME-AIME Conference, Atlanta, Ga.), it is deficient in that its specific gravity is not easily adjusted with acceptable diluting agents.

Unexpectedly, it has been discovered that a stable heavy liquid parting medium with a specific gravity between 1 and 1.50 can be prepared by emulsifying specific quantities of trichlorofluoromethane and water and that this new heavy liquid parting medium can effectively beneficiate as-mined coal in a single sink-float processing step.

A chemical emulsifying agent is first dissolved in trichlorofluoromethane followed by the addition of sufficient water to produce the desired specific gravity. The emulsifying agents found to be most effective are oleates and, more specifically, a blend of lipophilic sorbitan monooleate (SPAN 80) and hydrophilic polyoxyethylene-(5)-sorbitan monooleate (TWEEN 81) having an HLB value of 8. (SPAN and TWEEN are registered trademarks of ICI Americas, Inc.) For example, 5 ml of the emulsifier mix (1/1 blend by volume) was added to 200 ml of trichlorofluoromethane (1.6% by weight emulsifiers to solvent) followed by the addition of 50 ml of water. Agitation in a blender formed an emulsion of a new heavy liquid with a 1.39±0.01 specific gravity as determined by a hydrometer (calculated specific gravity is 1.40). The water and trichlorofluoromethane emulsion will remain stable, based upon hydrometer readings, for at least a day with only slight change in the specific gravity, unless subjected to temperatures near or above 74° F. (24° C.) the boiling point of trichlorofluoromethane.

The specific gravity of this new heavy liquid can subsequently be changed to a higher or lower level without any apparent effect on stability. Water (50 ml) was added and agitated with the 1.40 specific gravity emulsion. The specific gravity of the resulting stable emulsion was lowered to 1.34±0.01 (calculated specific gravity 1.33).

Further illustrative of this ability to dilute with either water or trichlorofluoromethane without destroying the emulsion is the following example in which a single emulsifying agent was used. Trichlorofluoromethane (200 ml), water (50 ml) and polyoxyethylene-(5)-sorbitan monooleate (TWEEN 81) (20 ml) were blended to yield a stable emulsion of about 1.39 specific gravity. Two 100 ml samples of this emulsion were taken. Water (10 ml) was added to one and trichlorofluoromethane (10 ml) was added to the other. Both modified emulsion samples retained their stability and then were combined to afford a stable emulsion with a specific gravity of 1.35. To this emulsion was added water (20 ml) to give a stable emulsion having a 1.33 specific gravity; further addition of water (40 ml) resulted in a still stable mixture of less than 1.27 specific gravity. Trichlorofluoromethane was then added in three successive 40 ml portions each yielding in turn stable emulsions having specific gravities of 1.29, 1.32 and 1.34 respectively. After each of the above steps the emulsion was considered to be stable if there was no noticeable phase separation for several minutes whereupon the next addition of a liquid was performed. After standing for two days, the emulsion was still stable with a 1.32 specific gravity.

Another noteworthy characteristic of the new heavy liquid parting medium is that a water-trichlorofluoromethane emulsion formulated for a specific gravity of 1.40 with 4.8% by weight of polyoxyethylene-(5)-sorbitan monooleate (TWEEN 81) had a viscosity less than that of water.

Although a new heavy liquid parting medium whose density can be adjusted to a preselected value has been described, it would be of little practical consequence if it could not effectively separate mixtures of solids. The following examples demonstrate the sink-float separating capability of water-trichlorofluoromethane emulsions for the beneficiation of as-mined coal. These bench scale emulsion separations of coal from the refuse were performed using asmined Pittsburgh seam ($-\frac{1}{2}''\times 0$ mesh) having the following typical clean coal size consist:

| Size | Wt % |
|---|---|
| $+1\frac{1}{2}''$ | 23.28 |
| $1\frac{1}{2}'' \times \frac{3}{4}''$ | 26.37 |
| $\frac{3}{4}'' \times \frac{1}{4}''$ | 19.84 |
| $\frac{1}{4}'' \times 28$ mesh | 24.11 |
| $28 \times 100$ mesh | 3.84 |
| $100 \times 325$ mesh | 1.48 |
| $-325$ mesh | 1.08 |

The chemical analysis of the clean Pittsburgh seam coal was 6.8% ash and 1.20% sulfur. Recovery of clean coal from run-of-mine coal was 65%.

The standard heavy organic liquids used as reference parting media were the commercially available heavy liquids marketed under the registered trademark Certigrav by American Minechem Corporation.

EXAMPLE I

Parallel sink-float separations were performed on as-mined Pittsburgh seam $\frac{1}{2}''\times 0$ coal using a standard heavy organic liquid (Certigrav) of 1.40 specific gravity and an emulsion prepared by blending trichlorofluoromethane (400 ml), water (80 ml) and polyoxyethylene-(5)-sorbitan monooleate (TWEEN 81, HLB 10) (20 ml) and having a 1.40 specific gravity.

| | Wt (g) | Wt % | Ash % | Σ Ash % |
|---|---|---|---|---|
| Certigrav (1.40) | | | | |
| Floats (coal) | 35.1 | 66.0 | 5.2 | 5.2 |
| Sinks (refuse) | 18.1 | 34.0 | 50.2 | 20.5 |
| Emulsion (1.40) HLB = 10 | | | | |
| Floats (coal) | 76.6 | 71.7 | 5.5 | 5.5 |
| Sinks (refuse) | 30.2 | 28.3 | 61.6 | 21.4 |

EXAMPLE II

Another emulsion having a 1.40 specific gravity was prepared by blending trichlorofluoromethane (200 ml), water (50 ml) and an emulsifier mixture (2 ml) of polyoxyethylene-(4)-sorbitan monolaurate (TWEEN 21, 42%) and sorbitan monooleate (SPAN 80, 58%) having an HLB value of 8.

| Emulsion (1.40) HLB = 8 | Wt (g) | Wt % | Ash % | Σ Ash % |
|---|---|---|---|---|
| Floats (coal) | 91.8 | 76.7 | 6.9 | 6.9 |
| Sinks (refuse) | 27.9 | 23.3 | 69.9 | 21.6 |

The data shows that the heavy liquid emulsions made an acceptable separation of coal from refuse. However, the separations were made at a slightly higher effective specific gravity than 1.40 as evidenced by the higher ash content of the floats.

Examples III–V which were separations conducted with various sized coal reveal that particle size of the coal is an important factor in the beneficiation process.

EXAMPLE III

Comparative separations of as-mined $-\frac{1}{2}''+8$ mesh coal were run using Certigrav (1.40 specific gravity), trichlorofluoromethane (1.50 specific gravity) and an emulsion (1.40 specific gravity) prepared from trichlorofluoromethane (200 ml), water (50 ml) and an emulsifier mixture (2 ml) comprising polyoxyethylene-(4)-sorbitan monolaurate (42%) and sorbitan monooleate (58%) and having an HLB value of 8.

| | Wt (g) | Wt % | Ash % | Σ Ash % |
|---|---|---|---|---|
| Certigrav (1.40) | | | | |
| Floats | 533.5 | 73.8 | 5.2 | 5.2 |
| Sinks | 189.1 | 26.2 | 65.5 | 21.0 |
| Trichlorofluoromethane (1.50) | | | | |
| Floats | 547.3 | 75.6 | 6.1 | 6.1 |
| Sinks | 176.4 | 24.4 | 76.9 | 23.4 |

The components of the emulsion were mixed in a blender for 15 seconds, the coal sample was put into the emulsion and it immediately separated. The floats were spooned off.

| Emulsion (1.40) | | | | |
|---|---|---|---|---|
| Floats | 541.7 | 74.3 | 5.2 | 5.2 |
| Sinks | 187.5 | 25.7 | 66.9 | 21.0 |

EXAMPLE IV

The experiment of Example III was repeated using as-mined −8+48 mesh coal.

| | Wt (g) | Wt % | Ash % | Σ Ash % |
|---|---|---|---|---|
| Certigrav (1.40) | | | | |
| Floats | 168.7 | 71.4 | 4.7 | 4.7 |
| Sinks | 67.7 | 28.6 | 70.3 | 23.4 |
| Trichlorofluoromethane (1.50) | | | | |
| Floats | 183.7 | 75.3 | 5.3 | 5.3 |
| Sinks | 60.2 | 24.7 | 75.8 | 22.7 |

The emulsion ingredients were mixed in a blender for 15 seconds. The coal sample was added and separated immediately. The floats were spooned off.

| Emulsion (1.40) | | | | |
|---|---|---|---|---|
| Floats | 176.5 | 73.2 | 5.2 | 5.2 |
| Sinks | 64.7 | 26.8 | 75.6 | 24.1 |

EXAMPLE V

The experiment of Example III was repeated with as-mined −48×0 mesh coal.

| | Wt (g) | Wt % | Ash % | Σ Ash % |
|---|---|---|---|---|
| Certigrav (1.40) | | | | |
| Floats | 51.6 | 31.7 | 8.2 | 8.2 |
| Sinks | 111.1 | 68.3 | 45.3 | 33.5 |
| Trichlorofluoromethane (1.50) | | | | |
| Floats | 73.2 | 44.7 | 11.8 | 11.8 |
| Sinks | 90.7 | 55.3 | 43.1 | 29.1 |

The water, solvent and emulsifiers were mixed in a blender for 15 seconds. The coal sample was added to the emulsion and after 20 min. the floats were vacuumed off. More emulsion was added and after standing for 15 minutes the floats were vacuumed off until the surface appeared to be clear.

| Emulsion (1.40) | | | | |
|---|---|---|---|---|
| Floats | 57.0 | 79.4 | 19.1 | 19.1 |
| Sinks | 14.8 | 20.6 | 66.1 | 28.8 |

Particles of coal and refuse coarser than 8 mesh separated as completely in the emulsion as in a standard organic heavy liquid at the same specific gravity. When these particles were of a size consist greater than 48 but less than 8 mesh, the emulsion performed slightly less efficiently than the standard heavy liquid but comparable to trichlorofluoromethane based on the ash content of the floats. Particles finer than 48 mesh, however, cannot be separated efficiently with the emulsion although a separation is effected. This relatively poor separation is apparently due to high ash refuse particles being trapped in the clean coal floats. Generally, the amount of particles finer than 48 mesh (−48 mesh) in a raw mined coal will be about 5% of the total amount, and thus product quality may not be adversely affected by treating the fines with the material that is coarser than 48 mesh (+48 mesh). If such separations do affect product quality, the fines could be separated by non-emulsion means. A possible scheme for a commercial installation would use an emulsion separation at a specific gravity less than 1.50 on coarse sizes and a straight trichlorofluoromethane separation at 1.50 on the fine.

Further development of the emulsion process could also lead to techniques that would provide for more efficient separations on the minus 48 mesh particles.

Examples VI and VII show that acceptable coal/-refuse separations are obtained by adding the raw coal to either the water or the heavy liquid prior to forming the parting emulsion by addition of the second liquid.

EXAMPLE VI

Raw coal (½"×8 mesh) was added to a solution of an emulsifier mixture (5 ml, HLB=8) comprising polyoxyethylene-4-sorbitan monolaurate (42%) and sorbitan monooleate (58%) in trichlorofluormethane (200 ml). Water (50 ml) was then added to the coal-heavy liquid mixture and an emulsion was formed by pouring from beaker to beaker.

| Emulsion (1.40) | Wt (g) | Wt % | Ash % |
|---|---|---|---|
| Floats | 75.8 | 76.1 | 4.5 |
| Sinks | 23.8 | 23.9 | 63.0 |

EXAMPLE VII

Using the same quantities of trichlorofluoromethane, water and emulsifier mixture as in Example VI, raw coal (½"×8 mesh) was added to the water to yield a mixture which was then combined with the emulsifying reagent-trichlorofluoromethane solution to form an emulsion by pouring from beaker to beaker.

| Emulsion (1.39) | Wt (g) | Wt % | Ash % |
|---|---|---|---|
| Floats | 41.1 | 75.0 | 5.7 |
| Sinks | 13.7 | 25.0 | 74.4 |

The above examples demonstrate the use of a water in oil emulsion as the parting medium in sink-float separations. In Example VIII an oil in water emulsion prepared using bromoform ($CHBr_3$, sp. gr. 2.86) and water effectively separates coal from refuse.

EXAMPLE VIII

Bromoform (55 ml), water (220 ml) and 10 ml polyoxyethylene-(20)-sorbitan monolaurate (TWEEN 20, HLB 16.7) were blended to produce a stable emulsion having a specific gravity of 1.35 as measured by a hydrometer. A sample of as-mined Pittsburgh seam coal ½"×+8 mesh) was separated as follows:

| Emulsion (1.35 sp gr) | Wt (g) | Wt % | Ash % |
|---|---|---|---|
| Floats | 26.5 | 54.9 | 5.3 |
| Sinks | 21.8 | 45.1 | 62.9 |

EXAMPLE IX

An emulsion having a higher specific gravity than the emulsions of Examples I–VIII was created in order to make a separation of a prepared mixture of solids of higher specific gravities, namely pieces of anthracite and stones which were about ½"×⅛" in size. Bromoform (110 ml), water (140 ml) and 15 ml of polyoxyethylene-(5)-sorbitan monooleate (TWEEN 81, HLB 10) were blended to afford an emulsion with a specific gravity of 1.77 as measured by a hydrometer. The separation was successful with the ten anthracite pieces floating and the ten stone chips sinking. The weight split was as follows:

| Emulsion (1.77 sp gr) | Wt (g) | Wt % |
|---|---|---|
| Floats | 8.0 | 47.1 |
| Sinks | 9.0 | 52.9 |

EXAMPLE X

A parting emulsion having a specific gravity less than that of water was prepared from fuel oil of 0.84 sp gr (100 ml), water (100 ml) and 10 ml polyoxyethylene-(5)-sorbitan monooleate (TWEEN 81, HLB 10). The specific gravity of the stable emulsion was 0.94 as measured by a hydrometer. A prepared mixture of wood and stones was separated by this fuel oil-water emulsion. The separation was successful with the weight split as follows:

| Emulsion (0.94 sp gr) | Wt (g) | Wt % |
|---|---|---|
| Floats | 7.5 | 44.6 |
| Sinks | 9.3 | 55.4 |

All the steps of the bench scale separation processes including wetting, dispersion, speed of separation and drying of the separated materials proceeded in an acceptable manner. However, it was observed that use of emulsifying agents in amounts of 5% by volume or greater produced an oily film on the coal and refuse fractions. This may be beneficial in preventing the freezing of coal, the dusting of fines and the changing of coal moisture.

Typically in sink-float separation processes parting medium is dragged out of the separation tank in the form of a liquid coating on the recovered materials and presents a continuous loss of medium components. As mentioned previously, 1% or less by weight of emulsifiers based on total emulsion weight has produced stable heavy liquid emulsions. On this basis, if the solids exiting the separation vessel contained 10% (by wt) emulsion moisture, there would be a loss of emulsifying agent from the system amounting to about 2 lb/ton of material treated. However, this value could likely be reduced by rinsing the solids prior to the final drying step in which the liquids are recovered.

The FIGURE depicts a preferred embodiment of the invention for beneficiating coal with an emulsion heavy medium in a sink-float separation process. The use of volatile or halogenated hydrocarbon solvents as a component of the parting medium mandates that the entire system be completely sealed in order to prevent losses by evaporation and to prevent pollution of the environment. Furthermore, the vapors of several of the halogenated hydrocarbons are toxic. Accordingly, health and cost considerations compel hermetically sealing means be incorporated throughout the system. Still further, the entire system should be operated under a very slight negative pressure to prevent any escape of heavy liquid vapors into the environment.

Referring to the FIGURE, raw coal which has been crushed and ground preferably to ½"×0 is conveyed from a storage bin via a conventional feeder 10, such as a screw feeder, into conditioner 12 where the raw coal is mixed with an amount of the emulsion parting medium from line 14 sufficient to wet the solids and form a slurry. The slurry passes by line 16 into separator 18 containing a parting liquid bath comprising an emulsion of water and a heavy liquid which causes the particles composing the raw coal to separate according to their specific gravities, the coal particles reporting to the floats and the refuse particles reporting to the sinks. The emulsion parting medium is supplied to separator 18 from emulsifier 20 by lines 14 and 22. The emulsifier 20 may be any apparatus or means known to those in the art for generating an emulsion after the addition of water by line 24, emulsifing agents by line 26 and heavy liquid from line 28 and 30. The separator 18 may be any vessel known in the art for performing a sink-float separation and having means such as conveyors to separately remove the floats and sinks. A portion of the emulsion parting medium may be recirculated by line 32 to the emulsifier 20 in order to maintain a steady level of medium in the separator as well as maintaining the constitution of the medium by constantly regenerating it in the emulsifier 20.

The coal floats and the refuse sinks are separately transported to reagent recovery stages 34 and 36, respectively, in which the coal and the refuse are sprayed with the heavy liquid from lines 38 and 40 to wash the emulsifying agents in the adhering emulsion heavy medium from the solids. The recovered emulsifiers and heavy liquid are collected and conveyed in lines 42 and 44 to line 28 for reuse in forming the emulsion heavy medium.

The washed coal and refuse next pass to their associated driers 46 and 48 in which the solids are exposed to indirect heating to evaporate any heavy liquid which may be coating the solids. In addition to the driers 46 and 48, all the stages in the process stream which contain heavy liquid including the emulsifier 30, the conditioner 12, the separator 18 and the reagent recovery stages 34 and 36 are constructed with duct-work depicted by dotted lines in the FIGURE to collect the heavy liquid vapors which are then passed to the heavy liquid regenerator 50 where the vapors are condensed or recovered in an oil or solvent. The recovered heavy liquid is sent by line 52 to a storage tank 54 from which the heavy liquid is supplied to the emulsifier 20 and the emulsifier recovery stages 34 and 36.

Emerging from coal drier 46 and refuse drier 48 are coal solids and refuse solids substantially free of any heavy liquid but possibly still containing water resulting from the breakdown of the emulsion in the driers as the heavy liquid evaporates. The temperatures in the driers should, as a minimum, be about the boiling point of the heavy liquid. Moreover, where the boiling point of the heavy liquid is below that of water (100° C.), the drier temperature should not exceed about 95° C. in order to minimize the amount of water vaporizing. In those instances in which the heavy liquid boils at a temperature approximately equal to or greater than the boiling point of water or the heavy liquid and water form an azeotrope, water will also be condensed and collected in the heavy liquid regeneration stage along with the heavy liquid. This should not pose a problem. Since the heavy liquid is immiscible with water and has a higher density, the liquids will stratify in the storage tank. The heavy liquid can be removed from the bottom and the water from the top.

The described preferred embodiment for practicing the invention in the beneficiation of coal was designed for trichlorofluoromethane being the heavy liquid component of the aqueous emulsion primarily because of its low boiling point (24° C.; 74° F.), low heat of vaporization (43.1 cal/g; 77.5 BTU/lb), attractive specific gravity of 1.50 and the fact that it is non-reactive with the coal. The worker in the field of gravity separation and the recovery of hydrocarbonaceous material from mineral solids is directed to U.S. Pat. Nos. 3,941,679, 4,055,480 and 4,067,616 to Smith et al and the paper by D. V. Keller, Jr., C. D. Smith and E. F. Burch supra for more information regarding the use of volatile chlorofluorocarbons, particularly trichlorofluoromethane, in dressing ores.

While embodiments of the present invention have been shown and described, it is apparent that various changes and modifications may be made such as using an emulsion parting medium comprising two or more water immiscible parting liquids and water. It is therefore intended in the following claims to cover all such modifications and changes as may fall within the true spirit and scope of this invention.

I claim:

1. A float and sink method for separating coarse coal particles from gangue in a coal ore wherein the coarse coal particles report as a float product and the gangue reports as a sink product in a separating device containing a heavy medium liquid, comprising:

(a) comminuting the coal ore to provide coarse and fine particles therein to a size consist of $-\frac{1}{2}$ inch by 0, (b) separating the comminuted particles into coarse particles having a size consist of $-\frac{1}{2}$ inch by +48 m from the fine particles having a size consist of −48 m by 0 in a screening step, (c) charging the coarse particles into the separating device containing a heavy medium liquid consisting of a water-trichlorofluoromethane emulsion having a specific gravity intermediate the specific gravities of the coal particles and gangue, (d) separating the coarse coal particles as a float product and the gangue as a sink product, (e) recovering the coarse coal particles and (f) passing the gangue to further processing.

2. The method of claim 1 wherein the separation in step (b) is at 48 m.

3. The method of claim 2 wherein the coarse particles have a size consist of $-\frac{1}{2}$ inch by 8 m.

4. The method of claim 2 wherein the coarse particles have a size consist of −8 m by +48 m.

5. The method of claims 2, 3 or 4 wherein the heavy medium liquid of step (c) is a water-trichlorofluoromethane emulsion having a specific gravity not greater than about 1.5.

6. The method of claims 2, 3 or 4 wherein the heavy medium liquid has a specific gravity between about 1 and about 1.5.

* * * * *